US005477784A

United States Patent [19]

Floegel

[11] Patent Number: 5,477,784

[45] Date of Patent: Dec. 26, 1995

[54] APPARATUS AND METHOD FOR PRINTING ON AND POLARIZING POLYMER ELECTRET FILM

[75] Inventor: Jack E. Floegel, Albuquerque, N.M.

[73] Assignee: Permacharge Corporation, Albuquerque, N.M.

[21] Appl. No.: 258,794

[22] Filed: Jun. 13, 1994

[51] Int. Cl.[6] ..... B41M 7/00

[52] U.S. Cl. ..... 101/489; 101/212; 101/487; 101/DIG. 37

[58] Field of Search ..... 101/487, 488, 101/489, DIG. 37, 424.1, 153, 170, 212, 216; 361/225, 230

[56] References Cited

U.S. PATENT DOCUMENTS

| | | | |
|---|---|---|---|
| 3,554,123 | 1/1971 | Lewallen | 101/489 X |
| 4,161,141 | 7/1979 | Lakhani | 101/DIG. 37 X |
| 5,103,263 | 4/1992 | Moore et al. | 101/DIG. 37 X |
| 5,205,212 | 4/1993 | Wolfe | 101/489 X |
| 5,279,103 | 1/1994 | Hahne | 101/488 |

*Primary Examiner*—Chris A. Bennett
*Attorney, Agent, or Firm*—Calvin B. Ward

[57] ABSTRACT

A novel apparatus and method for printing on polymer film while electrically polarizing the film or, in the case where the film has been polarized prior to printing, maintaining the film's electrostatic charge. The apparatus is incorporated into a printer and includes an ink applicator which applies the ink according to selected designs and colors and a heater for drying the ink. The improvement in the apparatus comprises a charging station which forms an electrostatic charge on the printed polymer film, immediately after the polymer film passes through the ink curing station. The method of printing on polymer film comprises applying a selected pattern of ink to the polymer film, heating the polymer film to a sufficient temperature to dry the ink of said pattern and to render the film electrically polarizable, and generating a net surface charge on the film. The resulting electrostatic charge across the polymer film will enable the film to be attach to an electrically insulated any flat surface, including but not limited to wood, glass, drywall, wallpaper, and metal.

9 Claims, 2 Drawing Sheets

APPARATUS AND METHOD FOR PRINTING ON AND POLARIZING POLYMER ELECTRET FILM

FIELD OF THE INVENTION

This invention relates generally to printing on polymer electret film. More particularly, this invention relates to self-adhering printed posters intended for display on walls.

BACKGROUND OF THE INVENTION

It is common practice to affix printed posters, calendars and the like to a flat, vertical surface, e.g, a wall. The purposes for doing so are wide and varied. For example, there is the college student who wants to decorate his or her dorm walls but cannot afford framed pictures and is prohibited by school authorities from mounting any materials requiring nails to be imbedded in the walls. Like most students, this student will choose to decorate his or her dorm walls by affixing unframed printed posters with tape, tacks, or other adhesive materials.

Several products are available in the art for affixing printed material to a vertical surface. Among the most common are tacks, adhesive tape, double-sided adhesive strips, or other adhesive materials, and paper that is manufactured with an adhesive on one side. These products have their individual disadvantages. Tacks will cause damage, although minimal, to the surface being affixed to. Although the tiny holes formed by imbedding a tack into a wall or other penetrable surface are necessary to the use of a tack, however, they may blemish the surface's appearance when the tacks are later removed and not replaced or subsequently covered. Adhesive tape, strips and the like are also disadvantageous. Some have a tendency to lose their adhesive quality after extended use. Others, although maintaining their adhesiveness, are difficult to remove from a surface. This can cause paint to lift or paneling to be tarnished when the adhesive material is removed. Another disadvantage of such products is that they can be used only once—their adhesive capability is lost once they are removed from a surface.

An alternative product known in the prior art is a polymer electret film, or in other terms, an electrostatically-charged plastic film. The electrostatically-charged film "sticks" to a vertical surface by means of the electrostatic charge created between the paper and the surface. An advantage of this product over the conventional methods discussed is the ability to be affixed and removed from a vertical surface more than once. In fact, the "adhesive" ability will last as long as the film remains electrostatically charged and clean. Additionally, unlike a tack or adhesive, there is no risk of damaging or blemishing walls and other surfaces.

The best process for the printing of posters on uncharged polymer film uses ultraviolet-curable inks which are applied using offset printing techniques commonly known in the art. The printed polymer film is then heated in order to accelerate the drying process. Electret film is not suitable for these printing processes known in the art. The heating process discharges or significantly reduces the electric charge of the film.

Accordingly, it is the main object of the present invention to provide an improved apparatus and method for generating posters which improves upon the prior art.

A further object of the present invention is to provide an apparatus and method for generating posters which are electrostatically charged.

SUMMARY OF THE INVENTION

The present invention provides a novel apparatus and method for printing on polymer film while electrically polarizing the film or, in the case where the film has been polarized prior to printing, maintaining the film's electrostatic charge.

One aspect of the present invention is drawn to an apparatus which is incorporated into a printer and includes an ink applicator which applies the ink according to selected designs and colors and a heater for drying the ink. The improvement in the apparatus comprises a charging station which forms an electrostatic charge on the printed polymer film, immediately after the polymer film passes through the ink curing station.

The resulting electrostatic charge across the polymer film will enable the film to be attach to any electrically insulated flat surface, including but not limited to wood, glass, drywall, wallpaper, and metal.

The various features of novelty which characterize the invention are pointed out with particularity in the claims annexed to and forming a part of this disclosure. For better understanding of the present invention and the advantages attained by its use, references are made to the accompanying drawings and descriptive matter in which the preferred embodiment of the invention are illustrated.

DETAILED DESCRIPTION OF THE INVENTION

The present invention adds a charging station to the typical printing process for the formation of an electret on polymer film or, in the alternative, for the retention of electret on polymer electret film. The initially uncharged polymer film or the polymer electret film will be polarized or repolarized, respectively, as part of the printing process, taking advantage of the heating technique used in most desirable printing processes to accelerate the drying process. For the purpose of avoiding repetition in describing the details of the present invention, reference is made only to the application using initially uncharged polymer film.

Figure 1:
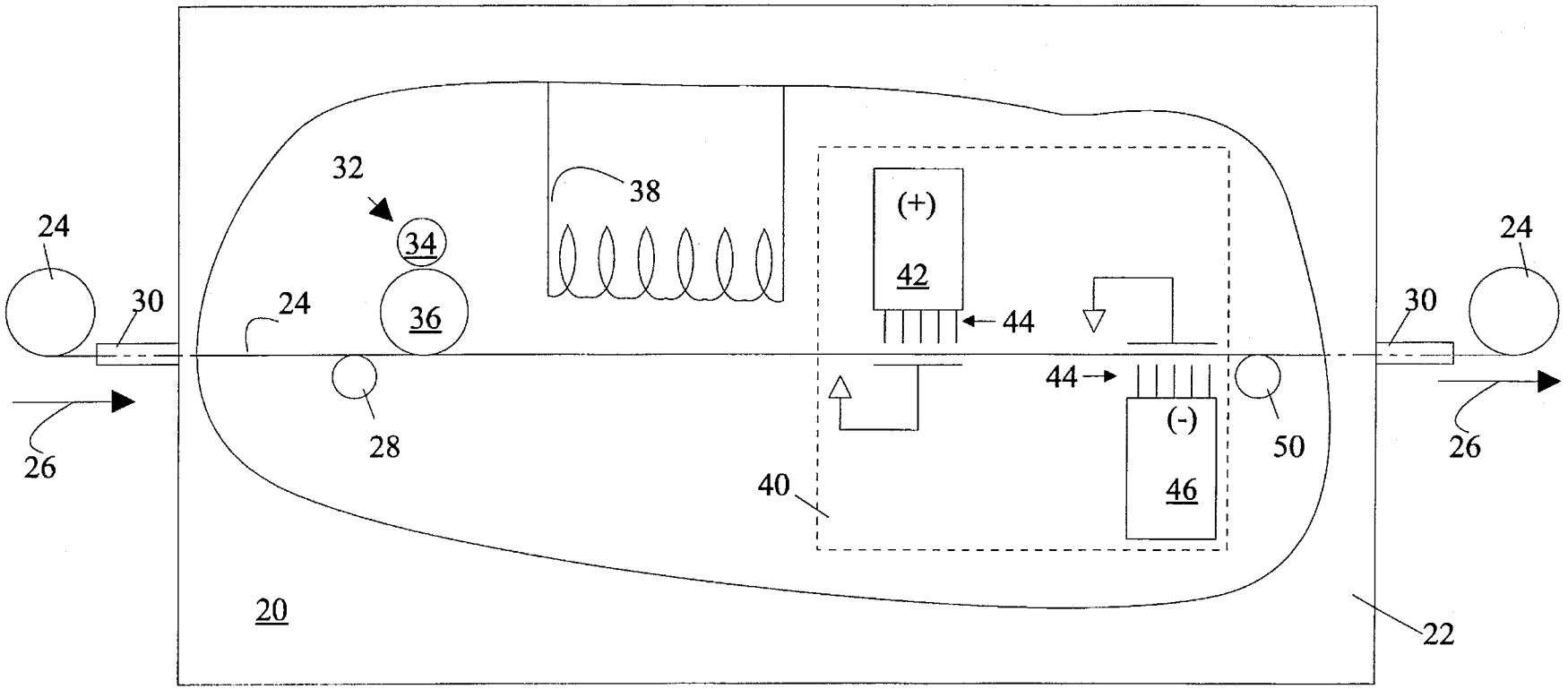
FIG. 1 shows a cutaway section of the printer arrangement of the present invention.

Referring now to the drawings generally and to FIG. 1 in particular, there is shown a cutaway view of the printer arrangement of the present invention. The printer arrangement 20 includes a housing 22 through which polymer film 24 travels in the direction indicated by arrow 26 by way of suitable means for passing and guiding, such as roller 28 and track 30.

Polymer film 24 first travels under ink applicator station 32 where it is printed with a predetermined design. Ink applicator station 32 consists of ink holder 34 and ink drum 36. In an offset printing process, typically from one to four colors of solvent- or water-based ink are used. Each color is applied at a station similar to 32.

Polymer film 24 then passes under heating station 38. At this point in the process, polymer film 24 is heated to a temperature ranging from 60° C. to 120° C., depending upon the type of ink used, in order to remove the solvent or water contained in the ink. In a preferred embodiment, polymer film 24 is heated to approximately 120° C.

Immediately after leaving heating station 38, polymer film 24 passes through charging station 40 comprising electrodes 42 and 46. Positive electrode 42 and negative electrode 46 are positioned on opposing sides (i.e., above and below) of polymer film 24. In a preferred embodiment, electrodes 42 and 46 each consists of a bed of tungsten needles 44 and 48, respectively. The tungsten needles are used to transfer an electric charge to polymer film 24. A ground potential is located opposite each electrode on the opposing side of polymer film 24. Charging of film 24 occurs by applying a large positive potential across electrode 42 and ground, and by similarly applying a large negative potential across electrode 46 and ground.

The charging phase of the process is required to immediately follow upon completion of the heating phase so as to form electrets at the highest temperature possible. Electrets which are formed at an elevated temperature are more stable and have a charge which is more deeply imbedded into the polymer film 24. The charging phase can be accomplished by a number of methods. They include but are not limited to (1) AC or DC Corona discharge, (2) simple polarization in a strong DC or AC field, (3) plasma treatment, and (4) combinations of the above three. In a preferred embodiment, polymer film 24 is treated with a DC corona discharge at a potential of between 5 KV and 20 KV DC applied across each of electrodes 42 and 46 and ground. The resulting printed polymer electret film, treated in this manner, will have a strong imbedded charge on the order of 1 KV DC when measured at the surface of the film.

Before exiting housing 22, polymer film 24, which is now electrically polarized, passes over suitable cooling means 50 where it is cooled down to room temperature. In a preferred embodiment, the suitable cooling means consists of a chilled roller 50. Upon exiting housing 22, the printed polymer film 24 is rewound or sheeted to an appropriate size.

Figure 2:
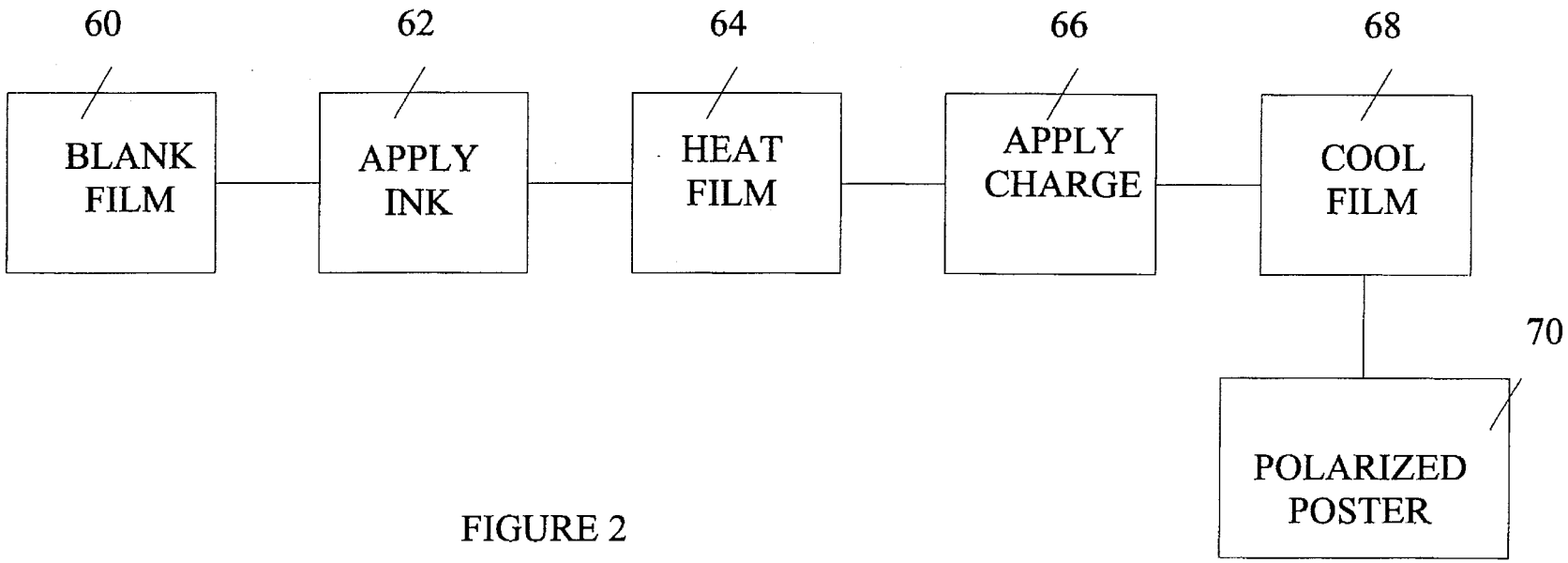
FIG. 2 shows a block diagram of the process of the present invention.

Referring now to FIG. 2, there is shown a block diagram of the steps of the present invention. The procession of steps is as follows: First, the polymer film, in an uncharged or precharged state 60, is fed into the printer arrangement, ink is applied 62 alter which it is heated to a sufficient temperature 64 to dry it. Immediately after heating is completed, the film is polarized 66 at a determined potential. The film is then cooled to room temperature 68 before exiting the printer. The final product is a polarized polymer film (i.e., polymer electret film) 70 which is in the form of a printed poster.

The terms and expressions which have been employed in the foregoing specification are used therein as terms of description and not limitation, and there is no intention in the use of such terms and expressions, of excluding equivalents of the features shown and described or portions thereof, it being recognized that the scope of the invention is defined and limited only by the claims which follow.

What is claimed is:

1. An apparatus for printing on polymer film, comprising:

(a) means for applying a selected pattern of ink to the polymer film;

(b) heating means for heating the film to a temperature sufficient to dry said ink and to render the film electrically polarizable;

(c) means for generating a net surface charge on the film whereby the film becomes electrically polarized.

2. The apparatus of claim 1 further comprising transport means for moving the polymer film sequentially past said means for applying a selected pattern of ink, said heating means and said means for generating a net surface charge.

3. The apparatus of claim 1 wherein said means for generating a net surface charge comprises first and second electrodes positioned on opposite sides of the polymer film.

4. The apparatus of claim 3 wherein said first and second electrodes each comprises a bed of tungsten needles.

5. The apparatus o:f claim 1 further comprising cooling means for reducing said temperature of the polymer film.

6. A method of printing on polymer film, comprising the steps of:

(a) applying a selected pattern of ink to the polymer film;

(b) heating the polymer film to a sufficient temperature to dry the ink of said pattern and to render the film electrically polarizable; and (c) generating a net surface charge on the film.

7. The method of claim 6 wherein said step of generating a net surface charge comprises the step of providing an electrostatic charge on the film.

8. The method of claim 6, wherein said steps of applying a selected pattern of ink, heating, and generating a net surface charge take place in succession.

9. The method of claim 6 further comprising the step of cooling the polymer film to approximately room temperature.

* * * * *